US005129189A

United States Patent [19]

Wetscher

[11] Patent Number: 5,129,189

[45] Date of Patent: Jul. 14, 1992

[54] GRINDING BODY

[75] Inventor: Klaus Wetscher, Uderns, Austria

[73] Assignee: Tyrolit Schleifmittelwerke Swarovski K.G., Schwaz, Austria

[21] Appl. No.: 713,287

[22] Filed: Jun. 11, 1991

[30] Foreign Application Priority Data

Jul. 23, 1990 [AT] Austria ..... 1542/90

[51] Int. Cl.[5] ..... B24B 1/00

[52] U.S. Cl. ..... 51/296; 51/298; 51/307; 51/308

[58] Field of Search ..... 51/296, 298, 307, 308

[56] References Cited

U.S. PATENT DOCUMENTS

| | | | |
|---|---|---|---|
| 2,947,616 | 8/1960 | Coes, Jr. et al. | 51/296 |
| 3,874,856 | 4/1975 | Leeds | 51/296 |
| 4,350,497 | 9/1982 | Ogman | 51/296 |
| 4,364,746 | 12/1982 | Bitzer et al. | 51/298 |
| 4,421,526 | 12/1983 | Strickman et al. | 51/296 |
| 4,541,842 | 9/1985 | Rostorer | 51/296 |
| 4,799,939 | 1/1989 | Bloecher et al. | 51/296 |

*Primary Examiner*—William R. Dixon, Jr.
*Assistant Examiner*—Willie J. Thompson
*Attorney, Agent, or Firm*—Wenderoth, Lind & Ponack

[57] ABSTRACT

A grinding body having a matrix comprising a binding agent (1), abrasive grain (2) and filling materials. The matrix which is of a Shore hardness of between D 35 to D 95, preferably D 70 to D 80, is provided with filling means comprising porous conglomerates (3).

14 Claims, 1 Drawing Sheet

GRINDING BODY

DESCRIPTION

The invention relates to a grinding body having a matrix comprising a binding agent, abrasive grain and occasionally filler materials.

The problem of the invention is that of so improving such a grinding body that it permits cooler grinding, with a substantially unaltered service life.

Particularly when hardened steel must be ground, it is important to avoid burning of the grinding wheel as otherwise there are changes in structure in the workpiece.

Examples of such workpieces are knife blades, tools and injection needles.

One possible way of dealing with workpieces of that kind is to use porous grinding bodies. However in that case there is the disadvantage of an increased amount of wear which is caused by the frequent grinding of edges, for example when grinding knife blades.

The problem according to the invention is solved in that the matrix which has a Shore hardness of between D 35 to D 95, preferably D 70 to D 80, is provided with filling means comprising porous conglomerates.

The coolant is better entrained by the porous conglomerates, thereby providing for cooler grinding. Nonetheless the strength of the wheel is not reduced and the wear thereof is not increased.

The filling means advantageously comprise resilient material. The resilient conglomerates have been found to be oscillation-damping, whereby from time to time the service life of the grinding body is increased, a better surface is produced and in particular the burning characteristic of the grinding tool is significantly improved.

An embodiment of the invention provides that the porous conglomerates are formed by polyurethane conglomerates.

The grinding effect of the grinding body can be improved by adding to the porous conglomerates abrasive grain with a grain size of 3 my (1200 mesh) to 2000 my (10 mesh).

The pore space of the conglomerates is between 5 and 90% by volume, preferably about 50% by volume.

The abrasive grain added to the porous conglomerates is advantageously formed by corundum, silicon carbide emery or garnet.

Filling materials such as for example chalk may further be added to the porous conglomerates.

The size of the porous conglomerates is advantageously between 2 mm and 100 mm (length or diameter).

A further embodiment of the invention provides that the porous conglomerates constitute from 1 to 60% by weight and preferably from 20 to 25% by weight of the grinding body.

An embodiment of the invention is described hereinafter with reference to the figures of the accompanying drawing.

Figure 1:
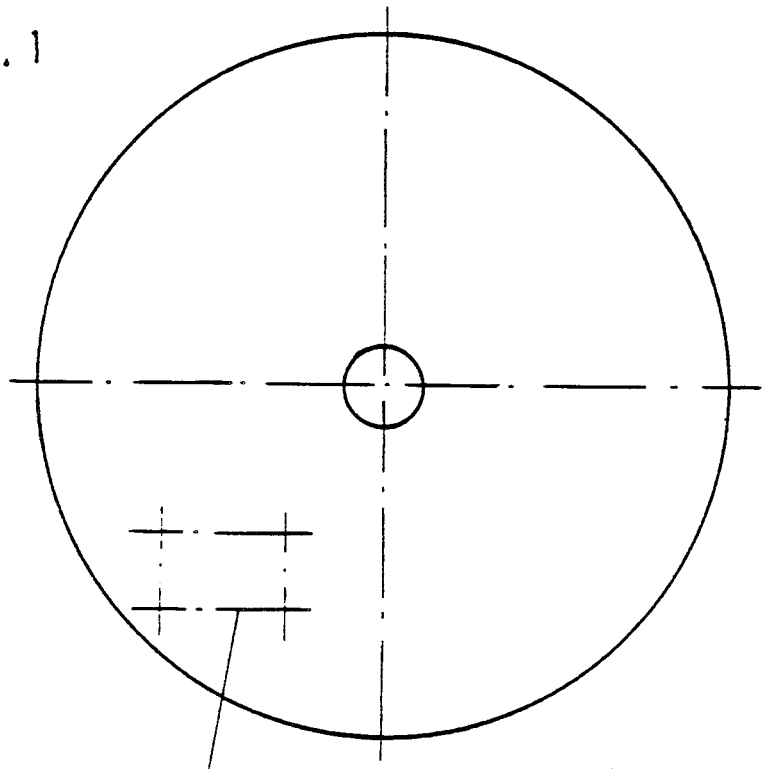
Figure 2:
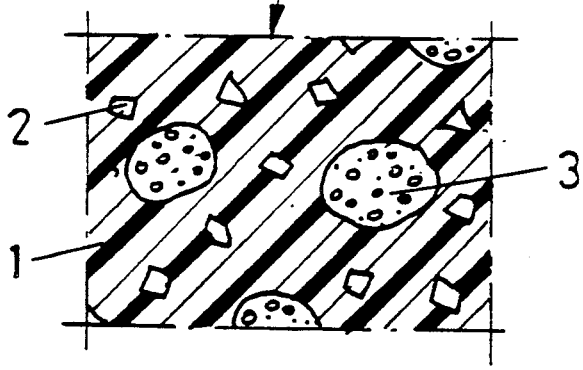

FIG. 1 is a diagrammatic view of a grinding body according to the invention, and FIG. 2 shows the section taken from FIG. 1.

The grinding body according to the invention comprises a matrix 1, the binding agent of which is formed in conventional manner by an epoxide, an unsaturated polyester, a mineral binder, a magnesite binder or a hard-set polyurethane. The matrix 1 is relatively hard and in the described embodiment has a Shore hardness of D 75.

Abrasive grains 2 and conventional filling materials are disposed in the matrix 1.

In accordance with the invention porous conglomerates 3 are embedded in the matrix 1.

Set out below is the composition of an embodiment of the invention.

Unless otherwise stated, the percentages are percentages by weight.

| | |
|---|---|
| Matrix 1: | |
| Binding agent, epoxide with amine hardener | 32% |
| Abrasive grain 2, noble corundum white | 50% |
| Filling material (cryolite) | 8% |
| Porous conglomerates 3 | 10% |
| Structure of the conglomerates 3: | |
| Binding agent; polyurethane | 33% |
| Abrasive grain; silicon carbide with a grain size of 449 my (100 mesh) | 67% |
| Pore volume | 40% by volume |

Example of Manufacture of Porous Conglomerates

The following are added to 24 parts by weight of a mixture of polyols, tertiary amine and water, with an OH-number of 150:

9 parts by weight of isocyanate based on diphenylmethane (MDI) and 67 parts by weight of abrasive grain, based on silicon carbide, of a grain size of 149 my (100 mesh), and cast in plate form after homogenisation.

After hardening for 2 days at ambient temperature, the result obtained is polyurethane plates with the following characteristics:

SHA about 50–70

Density about 1.15

Pore volume about 40% by volume.

They are broken up to form pieces with a mean diameter of about 20 mm and used as porous conglomerates.

I. Example of manufacture of filled grinding bodies

The following are added to 23 parts by weight of a preformulated epoxy resin with an EP-value of 0.52;

9 parts by weight of a polyamine with the H-active equivalent mass of 75

50 parts by weight of noble corundum white, grain size 177 my (80 mesh), 8 parts by weight of cryolite, and 10 parts by weight of conglomerates in accordance with the foregoing example of manufacture, followed by homogenisation.

The grinding material was then cast in suitable moulds and the grinding bodies were hardened for 10 hours at ambient temperature. After removal from the mould the grinding bodies were subjected to finishing and dressing operations by means of conventional items of equipment (round stock straightening, bore turning etc).

Those grinding bodies can be used for grinding knife blades.

II. Example of manufacture of filled grinding bodies

Manufacture similarly to Example I, but using:

14 parts by weight of epoxy resin EP-value 0.58

4 parts by weight of a polyamine H-active equivalent 50

60 parts by weight of a mixture of normal corundum and noble corundum white, grain size 500 my (36 mesh), 8 parts by weight of cryolite, and 14 parts by weight of conglomerates 3—see example of manufacture of conglomerates.

Grinding bodies in accordance with the foregoing composition are suitable for grinding spiral spring ends, valves, ball bearing races and the like.

III. Example of manufacture of filled grinding bodies

Added to 27 parts by weight of a mixture of a polyester (based on o-phthalic acid, maleic acid, 1,2-polypropyleneglycol 67% in styrene) with 0.1% dimethylaniline and 3% of 50% benzoyl peroxide are 10 parts by weight of conglomerate 3—see the example of manufacture —followed by casting.

63% silicon carbide 149 my (100 mesh).

Hardening: 2 days at ambient tmeperature.

Grinding bodies of the foregoing composition are suitable for grinding very thin parts such as vegetable knives, cake slices, baking trays etc.

I claim:

1. A grinding body with a matrix comprising a binding agent, abrasive grain and optionally filling materials, wherein the matrix has a Shore hardness of D 35 to D 95, and is provided with filling means comprising porous conglomerates.

2. A grinding body according to claim 1, wherein the matrix has a Shore hardness of D 70 to D 80.

3. A grinding body according to claim 1, wherein the porous conglomerates are of resilient material.

4. A grinding body according to claim 1, wherein the porous conglomerates are formed by polyurethane conglomerates.

5. A grinding body according to claim 1, wherein abrasive grain of a grain size of from 1200 mesh to 10 mesh is added to the porous conglomerates.

6. A grinding body according to claim 1, wherein the pore volume of the porous conglomerates is between 5 and 90% of the volume of the conglomerates.

7. A grinding body according to claim 6, wherein the pore volume of the porous conglomerates is about 50% of the volume of the conglomerates.

8. A grinding body according to claim 5, wherein the abrasive grain is selected from the group consisting of corundum, silicon carbide, emery and garnet.

9. A grinding body according to claim 1, wherein filling materials are added to the porous conglomerates.

10. A grinding body according to claim 9, wherein the filling materials are chalk.

11. A grinding body according to claim 1, wherein the size of the porous conglomerates is between 2 mm and 100 mm.

12. A grinding body according to claim 1, wherein the porous conglomerates constitute from 1 to 60% by weight of the grinding body.

13. A grinding body according to claim 12, wherein the porous conglomerates constitute from 20 to 25% by weight of the grinding body.

14. A grinding body according to claim 3, wherein the porous conglomerates are formed by polyurethane conglomerates.

* * * * *